US008312578B2

(12) United States Patent
L'Hegarat et al.

(10) Patent No.: US 8,312,578 B2
(45) Date of Patent: Nov. 20, 2012

(54) GUIDE DEVICE FOR A MOTORIZED TABLE COMPRISING A UNIT THAT GROUPS THE TABLE CONTROLS TOGETHER

(75) Inventors: Jean-Marie L'Hegarat, Olivet (FR); Olivier Collot, Orléans (FR); Filipe Franco, Saint-Jean-de-Braye (FR)

(73) Assignee: Steris Surgical Technologies, Saran (FR)

( * ) Notice: Subject to any disclaimer, the term of this patent is extended or adjusted under 35 U.S.C. 154(b) by 273 days.

(21) Appl. No.: 12/296,600

(22) PCT Filed: Apr. 10, 2007

(86) PCT No.: PCT/FR2007/000599

§ 371 (c)(1),
(2), (4) Date: Feb. 25, 2009

(87) PCT Pub. No.: WO2007/116146

PCT Pub. Date: Oct. 18, 2007

(65) Prior Publication Data

US 2009/0193586 A1 Aug. 6, 2009

(30) Foreign Application Priority Data

Apr. 10, 2006 (FR) ..... 06 03176

(51) Int. Cl.
*A47B 71/00* (2006.01)

(52) U.S. Cl. ..... 5/600; 5/616; 5/607; 5/608; 180/65.1

(58) Field of Classification Search ..... 5/600, 618, 5/611, 617; 180/65.1
See application file for complete search history.

(56) References Cited

U.S. PATENT DOCUMENTS

| | | | | |
|---|---|---|---|---|
| 5,754,997 | A | 5/1998 | Lussi et al. | |
| 6,154,690 | A | 11/2000 | Coleman | |
| 6,772,850 | B1 | 8/2004 | Waters et al. | |
| 6,781,517 | B2 * | 8/2004 | Moster et al. | 340/825.19 |

FOREIGN PATENT DOCUMENTS

| | | | |
|---|---|---|---|
| DE | 299 11 321 | U1 | 10/1999 |
| EP | 0917868 | | 5/1999 |
| EP | 1 321 121 | A | 6/2003 |
| EP | 1530959 | | 5/2005 |
| WO | WO-2005/053178 | A1 | 6/2005 |

OTHER PUBLICATIONS

Hill-Rom®, VersaCare™ Bed Service Manual, Product No. P3200/P3201, MAN333 REV 2, First Printing 2004; 2d Edition 2005; 158 pages.
Hill-Rom®, The TotalCare® Bed System USER Manual, Sep. 2002; 51 pages.
Hill-Rom®, TotalCare Bed System Options and Accessories Manual,1999; 4 pages.

* cited by examiner

*Primary Examiner* — Robert G Santos
*Assistant Examiner* — Brittany Wilson
(74) *Attorney, Agent, or Firm* — Harness, Dickey & Pierce, P.L.C.

(57) ABSTRACT

The invention relates to a guide device for a motorized operating table comprising a bed intended to support a patent and a base supporting said bed, said base comprising a motor unit, of the type comprising a control unit intended to control the movement of the table, said control unit being coupled to the table motor unit, and characterized in that the control unit comprises a casing comprising housing designed to accommodate a control device intended to control the position of the bed with respect to the base supporting the bed and with respect to the movement of the motorized table.

23 Claims, 3 Drawing Sheets

GUIDE DEVICE FOR A MOTORIZED TABLE COMPRISING A UNIT THAT GROUPS THE TABLE CONTROLS TOGETHER

CROSS-REFERENCE TO RELATED APPLICATIONS

This application is a National Phase Entity of International Application No. PCT/FR2007/000599, filed Apr. 10, 2007, claiming priority to French Patent Application No. FR 06/03176, filed Apr. 10, 2006, both of which are incorporated by reference herein.

BACKGROUND AND SUMMARY

The invention relates to the field of motor driven operating tables, intended more particularly to surgical operations.

During surgical operations, patients have to be transferred from one place to another and more particularly from the induction room to the operation room, where they are to undergo the surgical operation, then from the operation room to the recovery room. The transfer of the patients is conventionally performed using transport trolleys which are manually pushed by the medical staff. They are transferred from their beds to the transport trolley to be brought to the operating room, where they are transferred from the transport trolley to the operating table. Such patient's transfers remain relatively not easy and entail for the medical staff injury hazards, and for the patient, a risk of worsening of injuries.

In an attempt to remedy the drawbacks related to such patients' transfers, operating tables have been proposed having an additional "transfer" functionality, i.e. making it possible to carry the patient from his or her bed and back to his or her bed after the surgical operation, without having to use a transport trolley. For example, a top of an operating table connected removably to a trolley is known from the application for European patent EP0917868. Advantageously, the top is successively transferred from the trolley to a fixed base, and reversely. Advantageously, the top is connected to a control unit intended to control a device driving an adjustable top using an electric motor. The control unit is arranged in the form of a separate unit and can be connected electrically to the top of the operating table. According to a particular configuration, the control unit is arranged in the form of a portable control apparatus.

Although the patient's transfer onto the operating table is no longer carried out with a direct handling of the patient, the system described however requires some physical strength to be able to move the top from one support to another. Besides, the system reveals to be difficult to handle. Such a system further has the drawback relating to the control unit arranged in the form of a separate unit. This reveals to be a problem during the patient's transfer, since no storage space is provided on the operating table for said control unit. In addition, due to the construction thereof, said control unit is cumbersome and little ergonomic.

A motor driven operating table controlled by a handlebar composed of two guiding arms intended to be respectively attached on either side of the table is also known from the application for European patent EP1530959. More particularly, said guiding arms are removably attached on the side rails of the table, said rails being used as an accessory holder. Said handlebar further comprises a control unit making it possible to control the operation or the stoppage of the motor, as well as the motion of the table (frontward operation and/or rearward operation) and the speed thereof. According to a particular configuration of the handlebar, the coupling of said control unit with the motor is performed optically, using infrareds.

The previously described handlebar reveals to be inappropriate, because of some of the characteristics thereof, to be used on an operating table having the transfer functionality. A first drawback of such a handlebar is related to the fact that the device controlling the position of the top, which is separated from the control unit, is a unit independent of the operating table. Said devices are so configured as to be positionable on the side rails for accessories positioned on either side of the table. Now, as there is no specific and protected location on the table, these are often forgotten on the rails, or damaged or deteriorated against the beds during the patients' transfer operations.

A second drawback is connected with the dissociated and distant position of the remote control device from the handlebar controlling the motion of the table. Now, during the patient's transfer operations from his or her bed onto the table, the user must regularly act on the remote control device of the table to adjust the height. In addition, the user must be able to make the table slope at any time in a case of emergency. Now, such a dissociation entails that the user must regularly switch from the control handlebar to the remote control device, whereas during a transfer operation, an important vigilance must be kept on the patient. In order to avoid the successive switching from one device to another, certain users prefer to hold the remote control device in their hands all along the transfer, which makes the guiding of the table rather difficult.

Another drawback is connected to the unidirectional control transfers, from the control unit to the motor, without any feedback of information. Thus, if the control unit transmits a motion command to the table, it remains "blind" for the execution of the command and for everything that happens on the table, more particularly as regards the motor electronics and the motor driven wheel. The user of the operating table has no way to know immediately the causes of the non-execution of the motion and possibly to remedy it.

Another drawback lies in the utilisation of wireless connections. Such connections can be interfered with and thus they are not reliable. Now, a bad communication between the control and the wheel generates speed variations, stops or even untimely failures. The communication through infrareds is further not recommended because of i) the slightest light interference may affect the transmission (ballast lightings such as neons as well as a too powerful lighting such as broad daylight greatly affect them), and ii) nothing happens if an operation area covers the infrared receiver or emitter. In addition, because of the low reliability of the infrared connection and of the absence of feedback from the motor, it seems difficult to increase the number of controls of the table from the handlebar. This is the reason why the motion of the operating table is limited to one motion mode, and by default the frontward operation.

Eventually, a last drawback is connected to the fact that the control handlebar is self-contained. This entails a regular electric loading, which may be particularly constraining depending on the use of said operating tables. Besides, it may happen that the controls are unloaded during the motion of the tables, which thus blocks them with the patients during the transfer thereof.

The present invention more particularly aims at remedying the drawbacks of the systems previously described by providing a control unit grouping the means controlling the motion of the table and the means controlling the positioning of the top of the table, so that the operating table is controlled by only one control system. For this purpose and according to a first aspect, the invention relates to a guiding device of a motor driven operating table comprising a top intended to support a patient and a base supporting said top, said base comprising a motor unit, of the type including a control unit intended to control the motion of the table, said control unit being coupled to the motor unit of the table, and characterised in that the control unit comprises a housing including a recess so arranged as to receive a control device intended to control the positioning of the top with respect to the base supporting the top.

Thus, all the controls of the operating table are grouped on only one control station, and the handling of the control device and the patient's transfer are facilitated, or even improved. In addition, the control device is necessarily "put away" because of the presence of a specific location dedicated thereto, which not only avoids any risk of being forgotten by the user, but also any risk of deterioration.

According to a first configuration of the invention, the recess opens at least on one side face of the housing, the side face advantageously constituting the front face of said housing. According to another configuration of the invention, the housing comprises an upper face and at least a side face, said housing opening on said upper and side faces, with the side face advantageously constituting the front face of said housing. According to a particular configuration of the invention, the recess if defined by two side walls and one bottom, said walls being connected together by a wall facing the opening formed on the side face of said housing (also called rear wall).

Advantageously, the side walls slightly converge towards the opening formed on the side face of said housing so as to form a pressing area for the control device between the side walls and to hold said control device in the housing. In addition, holding means may be provided for holding the control device in the recess. Advantageously, said holding means include an extension of the upper face of the housing above the recess.

Similarly, when the control device includes fixing means in the form of a hook, it can be advantageously used to enable the guiding of the control device in the recess. For this purpose, the housing will advantageously comprise guiding means of said control device in the recess, with said guiding means comprising a cavity formed in the bottom of the recess. The cavity will be so arranged as to allow the sliding of the means fixing the control device up to the abutting thereof against the rear wall of the recess. Advantageously, the rear wall of the recess includes electric coupling elements able to cooperate with matching electric coupling elements formed on the face of the control device intended to come into contact with said wall.

According to a second aspect, the invention relates to a motor driven operating table, of the type comprising a mobile top intended to support a patient associated with at least one actuator, a base supporting said top, said base comprising a motor unit, a device for controlling the positioning of the top coupled with the actuator, and a guiding device according to any one of the claims, said guiding device being integral with the top. Advantageously, the guiding device is removable.

BRIEF DESCRIPTION OF DRAWINGS

Other objects and advantages of the invention will appear clearly while reading the following description and referring to the appended drawings, in which.

DETAILED DESCRIPTION

Figure 1:
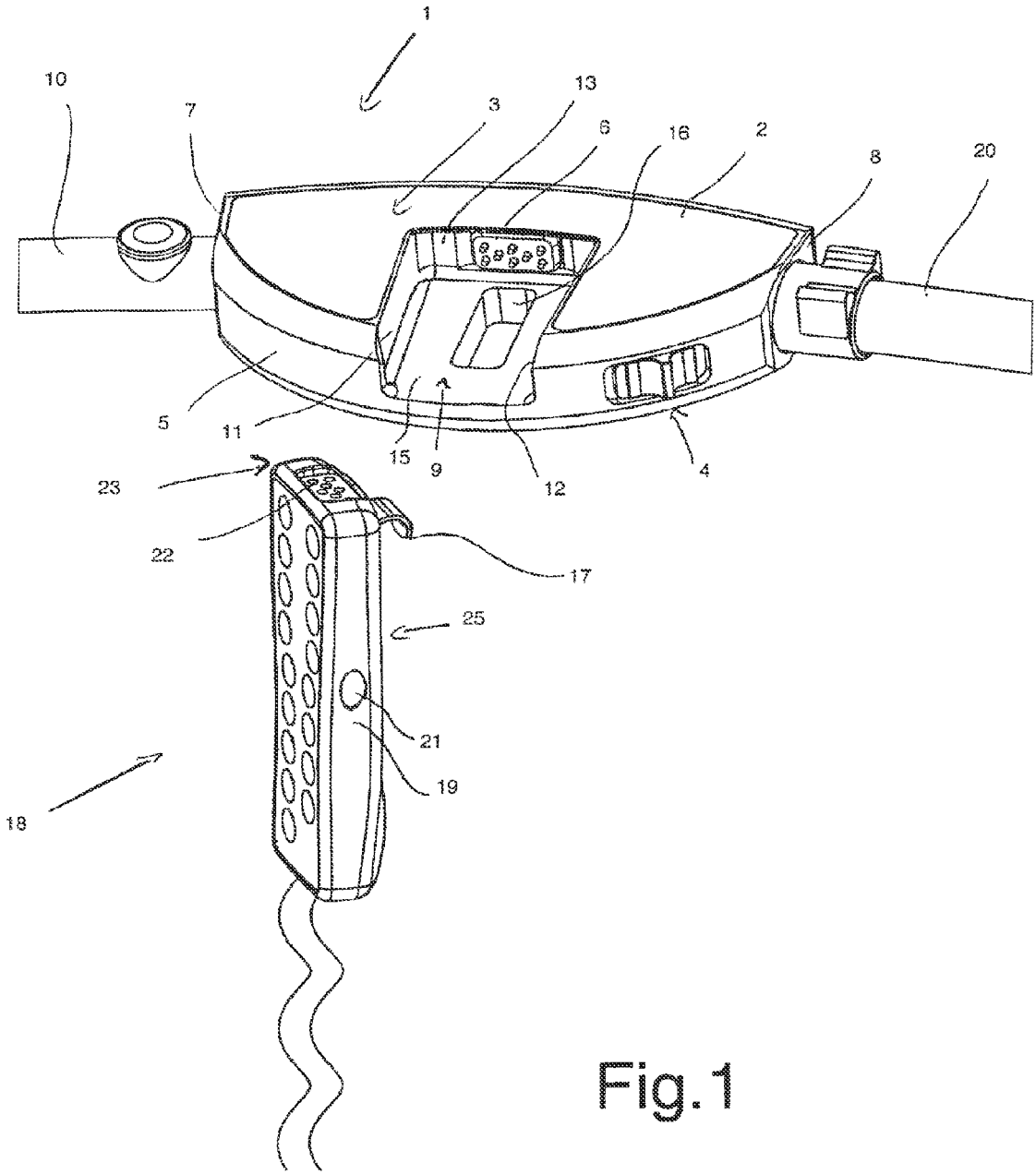
FIG. 1 illustrates a partial perspective view of a guiding device for an operating table, comprising a unit controlling the motion of the operating table and an associated control device, said control unit and said device being in an uncoupled position.
Figure 2:
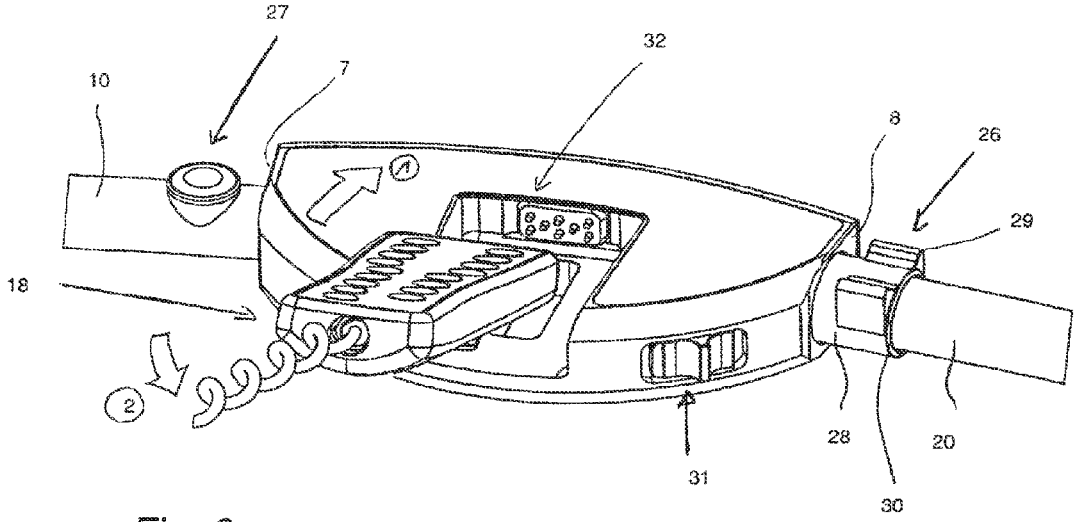
FIG. 2 illustrates a perspective view illustrating the positioning of the control device with respect to the control unit to be positioned thereof.
Figure 3:
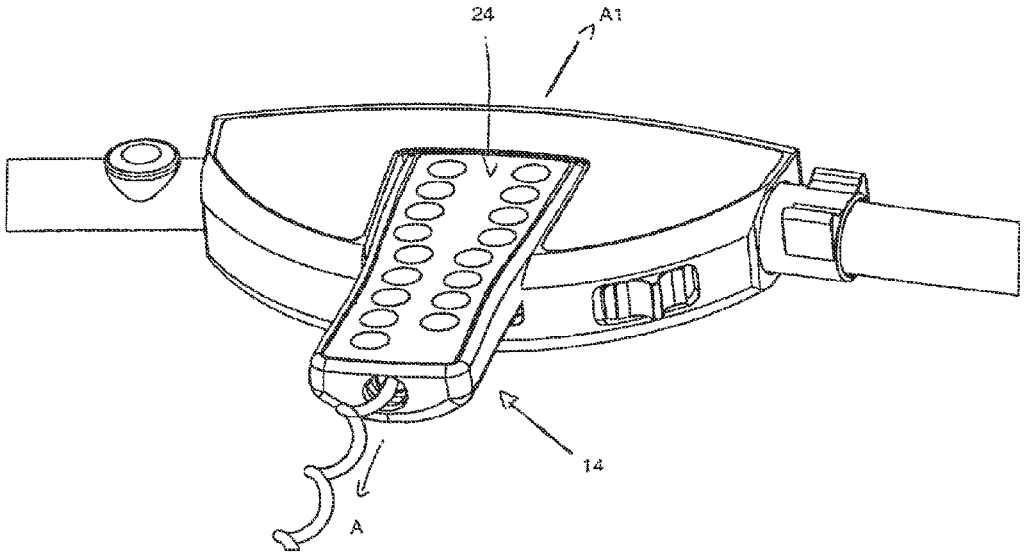
FIG. 3 illustrates a perspective view of the control device positioned on the control unit.
Figure 4:
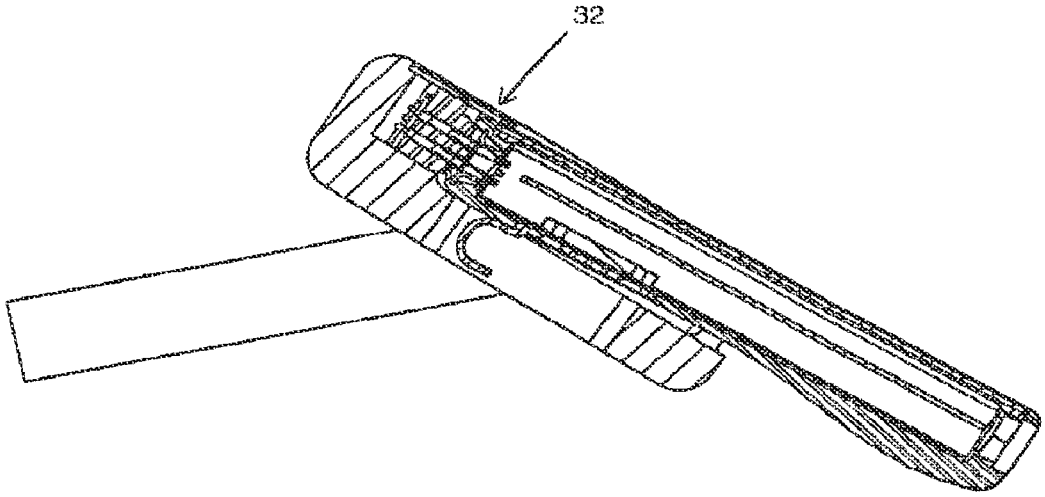
FIG. 4 illustrates a sectional view of the control unit of FIG. 3 along axis AA1.

As regards FIGS. 1 to 4, a device for guiding a motor driven operating table, more particularly intended to surgical operations, is described. According to a particular configuration, the operating table comprises a top for supporting a patient, said top being mounted on a supporting base. The base includes a motor, making it possible to actuate the motion of the table as well as a wheel associated with said motor. This will be called a motor driven wheel in the following. As regards the top, it is generally formed by a juxtaposition of three parts intended to receive the patient's head, back and hips, as well as his/her legs, respectively. Advantageously, the end parts (parts forming the headstall and the leg holders) are rotatingly mounted with respect to the central part of the top.

The operating table further includes rails fixed on the side edges of the top by means of cross pieces. More particularly, each part composing the top includes, on the respective side edges thereof, a rail. The rails thus positioned around the top make it possible to hang the accessories required by the surgeon during the surgical operation.

The guiding device according to the invention comprises a control unit 1 intended to control the motion of said operating table. The term "control the motion of the operating table" means the turning on and off of the motor of the table, the control of the front operation and the back operation of said table, as well as the control of the motion speed thereof. These operations are carried out by specific control means which will be described in greater details in the following. Control arms 10 and 20 extend either side of the control unit 1 in the same plane and symmetrically with respect to the longitudinal plane of the top. Advantageously, the guiding arms 10, 20 comprise fixing means at the end thereof, making it possible to removably fix them on either side of the top, respectively on a side rail.

The control unit 1 includes a housing 2 wherein electronics are positioned, which makes it possible to control the motion of the table. The housing 2 comprises an upper face 3 and a lower face 4, a front face 5 and a rear face, and two side faces 7 and 8. The terms "front" and "rear" define the faces of the housing 2 with respect to their positions with respect to the user handling the operating table.

The guiding arms 10 and 20 respectively extend on the side faces 7 and 8 of the housing 2. Said housing 2 includes, according to the described embodiment, a recess 9 intended to receive a control device 18 controlling the position of the top on the base or the position of the end parts of the top with respect to the central top. Said recess 9 is positioned on the upper part of the housing 2, so as to have an opening on the upper face 3 and an opening on the front face 5. The recess 9 is defined by a bottom 15 and two side walls 11 and 12 connected by a rear wall 13. The rear wall 13 faces the opening on the front face 5 of the housing 2. The rear wall 13 comprises a coupling element 6 of the electric type. Advantageously, said coupling element 6 is positioned into the rear wall 13 so that it can be drawn in.

According to a particular configuration of the invention, the side walls 11 and 12 of the recess 9 are slightly sloping so as to get slightly closer to each other on the front face 5 of the housing 2. Advantageously, the side walls 11 and 12 have a length which is greater than or equal to the length of the rear wall 13. Advantageously, the bottom 15 of the recess 9 further includes a longitudinal cavity 16 able to accommodate a hook 17 provided on said device when the control device 18 is inserted into the recess 9.

In the embodiment described, said control device 18 of the top consists in a remote control configured to be positioned in the recess 9 of the housing 2. More particularly, the control device 18 includes an upper part 24 and a lower part 14, said upper part 24 being configured so as to be positioned in said recess 9, and said lower part 14 so as to extend out of that recess 9. Advantageously, the upper part 24 has a substantially "triangular" shape, the width between the side walls 19 of the control device 19 being reduced up to the junction between the upper part 24 and the lower part 14. The upper area 21 in front of this narrow part is, with the convergent ends of the side walls 11 and 12 of the housing 2, a blocking area making it possible to stop the control device 18 in the recess 9.

The control device 18 further comprises, on the upper face 23 thereof, a coupling element 22 of the electric type, configured so as to cooperate with the coupling elements 6 positioned on the rear wall 13 of the recess 9. Advantageously, said control device 18 includes, on the rear face 25 thereof, a hook 17 making it possible to hang said control device 18 on the operating table, and more particularly on the side rails of the table. The control device 18 is positioned on the control unit 1 as follows (refer to FIG. 2).

The control device 18 is brought in front of the recess 9 of the housing, with the upper face 23 supporting the coupling element 22 being held substantially in the same plane as the coupling element 6 carried by the rear wall 13 of the recess, and being slightly sloping downward. The control device 18 which is partially positioned in the recess 9, slides rearward of the control unit 1 (refer to the arrow n°1), until the coupling elements 6 and 22 meet, thus establishing an electric contact. The hook of the control device 18 is simultaneously accommodated, then pulled up in the cavity 16. The control device 18 is then lowered (refer to the arrow n°2) until parts of the rear face 25 come into contact with the bottom 15 of the recess 9. The control device 18 is then held in the recess 9 by the areas 21 which get "pressed" against the convergent ends of the side wall 11 and 12 thus forming side stops for the control device 18. In order to prevent untimely extractions of the control device 18 from the recess 9 further to undue gestures against the lower part 14 of the control device 18 which extends out of the recess, the upper face 3 of the housing 2 advantageously comprises a slight extension 32 of the rear wall 13 which extends above the recess 9 (refer to FIG. 4), to form an upper stop. Advantageously, said control device 18 is interconnected and interchangeable with the control units provided for other guiding devices.

The control means controlling the motion of the operating table comprise:

- control means 26 making it possible to actuate the motion of the operating table in the desired direction,
- means for validating and securing 27 making it possible to confirm the motion of the operating table while obliging the user to keep his or her both hands on the handlebar, respectively,
- a selection key 31 making it possible to select the preferred direction for the table motion.

The control means 26 is advantageously positioned on the guiding arm 20 composing the right gripping handle of the guiding device. The control means 26 includes a control collar 28 surrounding the guiding arm 20. The control collar 28 comprises two side extensions 29 and 30 making it possible to rotate said collar around the guiding arm 20. The rotating motion of the extension 29 applied towards the table is the front motion control, and the rotating motion of the extension 30 towards the user forms the rear motion control.

The validation and securing means 27 is advantageously positioned on the guiding arm 10 which constitutes the left gripping handle of the guiding device, close to the side face 7 of the control unit 1. Said control means 27 is push-button actuated so as to control, on the one hand, the down motion and the up motion of the motor driven wheel, and on the other hand, the secure motion and the braking of the operating table. More particularly, the downward and upward motions of the wheel are actuated respectively by the pressure on and the release of the push-button. The secure motion is obtained by the user continuously pressing the push-button, the release of the push-button automatically entailing the slowing down of said table, with an upward motion of the motor driven wheel.

Another function of the push-button is to allow the user to confirm the speed control of the operating table. In addition and advantageously, the action of the validation and selection button 27 allows a rotation of said operating table on itself when the motor driven wheel is down. The selection button 31 is advantageously positioned on the front face 5 of the housing 2, between the opening of the front face 5 of the housing, and the side face 8 of the housing 2. The selection button 31 makes it possible for the user to choose the preferred direction for the forward motion of the table. Such control makes it possible to easily move the operating table towards the patient's head or feet, while preserving the same ergonomic motion. Then, the motion control 29 of the control means 26 can always be the front operation, and the motion control 30 can always be the rear operation.

This functionality of the control unit 1 is particularly important, more particularly depending on the fact that the guiding device, as it is removable from the operating table, is positioned on the front part of the top (part of the top supporting the patient's head), or on the rear part of the table (part of the top supporting the patient's legs). Thus and as an example, it will be advantageous, when the guiding device is fixed in front of the operating table, to select the rearward direction as the preferred frontward direction. Further, this functionality has another advantage in that it allows a pre-adjustment of the speed, so that the rearward motion will be carried out at a maximum speed which is lower than a motion frontward. For example, the rearward motion speed will be reduced by 50% with respect to the speed frontward.

In addition, the control unit 1 also includes means making it possible to set a maximum motion speed of the operating table. Such maximum speed will be selected depending on the travel of the operating table. More particularly, a maximum motion speed of the table will be slower as the places gone through during the travel of the table are narrow.

According to a particularly advantageous configuration of the invention, the control unit 1 includes communication means coupled to communication means connected to the operating table, with the communication between said means being bidirectional. Thus, in response to the command instructions sent by the control unit 1, the operating table will send back to said control unit 1 information relating to the execution, the non-execution or the non-conformity of the instructions sent by said control unit 1. The user is thus assured of the correct communication between the control unit 1 and the table, and he or she is informed of the situation of the motor driven wheel (up or down), of the selected preferred motion direction and the requested speed level. All the information can be seen on a screen formed on the upper face 3 of the control unit 1. More particularly, the preferred motion direction selected will be indicated by a LED.

The grouping of the guiding device, at the level of the control unit 1, of the control means 26, 27 and 31 controlling the motion of the operating table and of the remote control device 18 of the top, makes it possible to transfer the patient safely while simplifying and facilitating the access to the controls of the operating table. Advantageously, the coupling of the control unit with the motor is obtained using a secure wire connection (computer protocol). Advantageously, the control unit 1 is directly powered on the operating table. In addition, the guiding device composed of the control unit 1 and the control device 18 will have a balance shape to avoid the rotation motion seen on the prior art systems when they are removed from the operating tables.

The invention has been previously described as an example. It should be noted that the persons skilled in the art are liable to make various modifications in the invention without leaving the scope thereof.

The invention claimed is:

1. A surgical operating table control system comprising:

a rail-mounted unit including a driving wheel control switch and an interface, the driving wheel control switch controlling a characteristic associated with at least one of forward and backward motion of an entire surgical operating table; and a remote controller including a table orientation switch, the remote controller being removeably coupleable to the unit at the interface, the remote controller being in physical contact with the unit when coupled.

2. The control system according to claim 1, wherein the interface comprises an electrical connection.

3. The control system according to claim 1, wherein the interface comprises a recess including a cavity, the remote controller includes a hook which extends into the cavity, and the interface further comprises an electric coupler.

4. The control system according to claim 1, wherein the unit further comprises a driving wheel speed control switch and a driving wheel forward and reverse switch.

5. The control system according to claim 1, further comprising:

an indicator located on an upper face of the unit operably to display the table motion selected; and an electrical wire extending from an end of the remote controller opposite the interface when coupled to the unit.

6. The control system according to claim 1, wherein the remote controller is electrically operably when it is either removed from or coupled to the unit.

7. The control system according to claim 1, further comprising a rotatable collar moveable around an elongated arm extending from a central housing of the unit, rotation of the collar controlling table motion.

8. The control system according to claim 1, wherein the characteristic is forward movement of the entire surgical operating table caused by motorized wheel actuation.

9. The control system according to claim 8, wherein the characteristic also includes rearward movement of the entire surgical operating table caused by motorized wheel actuation, the rail-mounted unit being attached to and moveable with the surgical operating table.

10. The control system according to claim 1, wherein the characteristic is motor-actuated wheel speed of the entire surgical operating table.

11. The control system according to claim 1, wherein the driving wheel control switch and table orientation switch generally face outwardly toward a healthcare worker moving the operating table and generally away from a patient on the operating table, when the remote controller is coupled to the unit.

12. A system comprising:

a surgical operating table including a removeable patient-supporting top;

a first controller comprising an enlarged housing, a first elongated arm extending from a side of the housing and a second elongated arm extending from an opposite side of the housing, the arms attaching the first controller to the table, the first controller further comprising at least a first driving wheel up and down motion switch and a second driving wheel forward and reverse motion switch, the housing of the first controller additionally comprising at least three side walls and a bottom wall defining a receptacle; and a second controller comprising table top tilting controls, in one use condition the second controller being inserted into the receptacle of the housing of the first controller whereat the tilting controls can be actuated, and in another use condition the second controller being removeable from the receptacle of the housing whereat the tilting controls can also be actuated.

13. The system according to claim 12, further comprising:

an indicator located on an upper face of the first controller operably displaying the table motion selected;

an electrical wire extending from the second controller which is a remote control device; and the second switch comprises a rotatable collar moveable around one of the arms to control table motion.

14. The system according to claim 12, wherein a bottom surface of the receptacle further comprises a cavity, and the second controller is a remote controller including a rail-mounting hook which is received in the cavity of the housing when the remote controller is inserted in the first controller.

15. The system according to claim 12, wherein the receptacle of the housing includes convergent side wall ends within which is press fit a substantially triangularly shaped upper part of the second controller.

16. The system according to claim 12, wherein the first and second controllers have an electrical interface at a hidden area when mounted together.

17. A system comprising:

a motor driven, patient support assembly including a patient supporting area;

a housing mounted to the support assembly, the housing comprising a receptable having an openly accessible top and end, a surface defining a portion of the receptacle including a cavity, and an electrical connector located in the receptacle;

a driving wheel forward and reverse motion switch coupled to the housing;

a driving wheel speed switch coupled to the housing; and a driving wheel energization switch coupled to the housing the driving wheel switches being accessible to a healthcare worker and at least one of the driving wheel switches facing away from the patient supporting area.

18. The system according to claim 17, further comprising a remote controller comprising patient support tilting controls for the patient supporting area, the remote controller being inserted into the receptacle of the housing so that the controls of the remote controller are accessible through the open top by the healthcare worker without having to remove the remote controller from the housing.

19. The system according to claim 17, further comprising a remote controller comprising patient support tilting controls for the patient supporting area, the remote controller being inserted into the receptacle of the housing, the remote controller including an electrical connector which disengably contacts with the electrical connector of the housing when the remote controller is located in the receptacle of the housing.

20. The system according to claim 17, further comprising a remote controller comprising patient support tilting controls for the patient supporting area, the remote controller being inserted into the receptacle of the housing, an electrical wire extending from the remote controller to the patient support assembly.

21. The system according to claim 17, further comprising a remote controller comprising patient support tilting controls for the patient supporting area, a rail mountable hook projecting from the remote controller and being removably received in the cavity of the housing receptacle when the remote controller is received in the receptacle.

22. The system according to claim 17, wherein the patient support assembly is an operating table motionally controlled by only one control station which includes the housing, and the operating table also serves as a patient transport trolley.

23. The system according to claim 17, further comprising a handlebar extending from the housing and a motion validation button mounted to the handlebar, releasing of the button automatically causing at least one of forward and reverse motion of the table to slow down.

* * * * *